United States Patent [19]

Santarone

[11] Patent Number: 4,591,154

[45] Date of Patent: May 27, 1986

[54] PITCHING RUBBER AND HOME PLATE CONSTRUCTION

[76] Inventor: Pasquale A. Santarone, 13415 Blenfield Rd., Phoenix, Md. 21131

[21] Appl. No.: 520,310

[22] Filed: Aug. 4, 1983

Related U.S. Application Data

[63] Continuation-in-part of Ser. No. 514,663, Jul. 15, 1983, abandoned.

[51] Int. Cl.[4] ..... A63B 71/00

[52] U.S. Cl. ..... 273/25

[58] Field of Search ..... 273/25

[56] References Cited

U.S. PATENT DOCUMENTS

| | | | |
|---|---|---|---|
| 948,342 | 2/1910 | Pisel | 273/25 |
| 2,122,266 | 6/1938 | Seys | 273/25 |
| 2,225,496 | 12/1940 | Gethin et al. | 273/25 |
| 2,525,091 | 10/1950 | Bronawell | 273/25 |
| 2,662,768 | 12/1953 | Madsen | 273/25 |
| 2,662,769 | 12/1953 | Madsen | 273/25 |
| 3,479,028 | 11/1969 | Goeders | 273/25 |
| 3,508,747 | 4/1970 | Orsatti | 273/25 |
| 3,837,646 | 9/1974 | Goeders | 273/25 |

*Primary Examiner*—Richard C. Pinkham
*Assistant Examiner*—T. Brown
*Attorney, Agent, or Firm*—Schwartz, Jeffery, Schwaab, Mack, Blumenthal & Evans

[57] ABSTRACT

A pitcher's rubber construction having a casing partially embedded in a pitching mound with the upper end substantially flat with the ground. A pitcher's rubber is attached to the top of the casing. The rubber is attached to the casing by a pair of spaced apart guide ways formed in the casing and a pair of spaced apart runners formed on the interior of the rubber. The spacing of the runners corresponds to the spacing of the guide ways whereby the pitcher's rubber, through alignment of the runners with the guide ways, will longitudinally slide relative to the casing. The rubber is locked to the casing by a resiliently biased plunger extending upwardly through a guideway and plunger-receiving recesses formed in one of the runners. The position of the recess relative to the plunger is such that when the rubber is slidably moved along the casing, the plunger will be biased into the recess and thereby lock the rubber in place on the casing.

15 Claims, 14 Drawing Figures

PITCHING RUBBER AND HOME PLATE CONSTRUCTION

CROSS-REFERENCE TO RELATED APPLICATION

The present application is a continuation-in-part of Ser. No. 514,663 filed July 15, 1983 and since abandoned.

BACKGROUND OF THE INVENTION

The present invention relates as indicated to improvements in pitching rubber and home plate construction, and relates more particularly to improvements wherein the pitching rubber and home plate can be releasably locked in place on supporting casing for convenient removal and replacement.

Both pitching rubber and home plate are integral parts of the game of baseball and have been since the inception of the game. Home plate has traditionally been at essentially the same elevation as the surrounding playing field and batters' boxes, and this flatness is essentially dictated by the fact that players cross and slide into home plate. Pitchers' mounds, on the other hand, have traditionally been elevated or mound-shaped, and a pitching rubber is mounted at generally the top portion of the mound. In accordance with the rules of baseball, the pitcher must be in contact with the pitching rubber while throwing the baseball. The ordinary pitcher's rubber consists of a mat of elastic material, for example, rubber, and during the course of repeated use the rubber absorbs spike marks, some of which are relatively deep, and corners or edges of the rubber are also frequently broken off. In a similar manner, home plate, which is likewise formed of an elastic material such as rubber, is subjected to a high degree of wear. As a result, both home plate and the pitcher's rubber must frequently be replaced during the playing season.

At the present time at the major league level of baseball, the home plate and pitcher's rubber are rigidly secured to blocks of wood which are embedded in the home plate and mound area. To the best of applicant's knowledge, home plate and the pitcher's rubber are rigidly mounted in place by nailing the same to the wood blocks. Since the dimensions of the playing field must be precisely determined based upon the exact location of home plate and the pitcher's rubber, at the time of replacement of the home plate and pitcher's rubber, the distances between home plate, the pitcher's rubber and the bases must be carefully measured subsequent to replacement of home plate and the pitcher's rubber. This is obviously a very time consuming chore. Moreover, when the home plate and pitcher's rubber have degraded to the point that they must be replaced, they must be pried loose from their nailed securement, a laborious process. Since there are no precise guides or alignment means for replacement home plates and pitching rubbers, the above noted precise measuring is required.

A further disadvantage of present pitching rubber mounting arrangements is that the rubber is relatively thin and provides only a very limited surface against which the soles and spikes of the pitcher can engage during the pitching motion. This results in the dirt in front of the pitching mound being displaced which in turn makes it even more difficult to obtain proper contact by the pitcher.

Various attempts have been made in the prior art to ameliorate some of the noted disadvantages with regard to the ordinary mounting of home plate and the pitcher's rubber. In U.S. Pat. No. 948,342, a home plate is disclosed which can be removably secured to a metal plate embedded in the ground. However, the removability is primarily for the purpose of replacing a spent roll of paper or cloth which can be periodically drawn up over home plate to provide a clean and highly visible surface. There is no recognition in this prior art of the frequent need to replace home plate itself, nor is there disclosed therein any quick and convenient method of doing so.

In U.S. Pat. No. 2,662,769 to Madsen, pitching rubbers of various forms are disclosed, with certain of the forms providing a plurality of pitching surfaces. In each instance, the pitching rubber is secured to a block of wood by nails or mounting bolts, or both. When the exposed pitching surface has become worn, the pitching rubber and wood block to which it is secured can be rotated 90° so as to present a fresh surface. In such arrangement, both the rubber and the means embedded in the ground to which it is secured must necessarily be lifted and replaced, thereby requiring the time consuming measurement noted above. U.S. Pat. No. 2,662,768 to Madsen is similar in concept, providing a generally rectangular body of rubber the interior of which is reinforced to provide stability. The rubber can be rotated 90° to present a new pitching surface. This arrangement provides a pitching rubber assembly which is not satisfactorily stable when in place and which requires the necessary alignment when a new pitching surface is provided.

The concept of providing a permanent anchor for bases is disclosed in U.S. Pat. No. 3,508,747 to Orsatti. In the anchoring device of Orsatti, an anchor post is embedded in concrete, and a sleeve secured to the base is adapted to fit over the upper end of the post. Both the post and sleeve are rectangular in cross section so as to prevent rotation of the base. Although this type of base construction, commonly known as the "Hollywood" base, has proven highly satisfactory for base construction and mounting, the concept cannot be used to advantage in pitching rubber and home plate construction.

SUMMARY OF THE INVENTION

The principal and common feature of both the improved home plate and pitching rubber construction is the provision of a casing which can be embedded in the ground and constructed so as to slidably receive the home plate and pitching rubber in a releasable locking arrangement. This permits home plate and the pitching rubber to be removed when worn, and replaced by a similarly constructed home plate and pitcher's rubber, which can be quickly and easily mounted on the respective casings in precisely the same alignment. Since the embedded casings can be precisely aligned when embedded, there is no further need to align home plate, the pitcher's rubber and the bases when replacement home plates and pitching rubbers are mounted on and locked to the casings A more specific feature of the pitching rubber assembly is the provision of dove-shaped grooves or guide ways in the embedded casing which are adapted to receive similarly shaped runners mounted on the pitching rubber. A lock is mounted in one of the guide ways in the casing, with the plunger of the lock being spring biased and extending into the guide way. The associated runner formed on the underside of the pitching rubber is formed with an opening into which the plunger extends when the pitching rubber is slid longitudinally on the casing following alignment of the runners with the guide ways. In this manner, the pitching rubber is firmly locked in place in precisely the same location. The end of the runner formed with the opening for receiving the plunger is additionally formed with a slot which opens at the exterior of the pitching rubber so that a suitable tool can be inserted through the slot for depressing the plunger for sliding the pitching rubber out of contact with the casing, for replacement.

In the preferred form shown, the guide ways formed in the casing comprise a first guide way formed in the top surface of the casing and a second guide way formed in a side wall of the casing adjacent the top thereof. The pitching rubber is preferably L-shaped, with a runner being mounted on each leg and being spaced so as to be slidably received in the guide ways. The provision of an L-shaped rubber, as opposed to the normal flat slab rubber currently used, has the advantage of providing a downwardly extending rubber section at the front of the rubber which enhances the contact by the pitcher with the rubber The home plate assembly is similarly constructed. A casing is embedded in the ground, with the top of the casing being substantially flat and flush with the surrounding ground. The casing is formed with transversely spaced guide ways, with one of the guide ways having mounted therein a lock the plunger of which is biased upwardly into the guide way. The underside of the plate is formed with runners complimentary in shape to the guide ways formed in the casing and commensurately spaced. The runner associated with the guide way having the lock is likewise formed with an opening for receiving the plunger for maintaining the home plate in a locked position in which it is precisely aligned over the casing. The runner formed with such opening is also formed with a key slot accessible at one end of home plate to permit a tool to be inserted therein for depression of the plunger thereby permitting home plate to be slidably retracted from the casing, and replaced.

An alternative embodiment of pitching rubber and corresponding casing comprises forming the pitching rubber of generally shallow inverted U-shape, the purpose of which is to provide a second front rubber surface when the pitching rubber is removed from its releasable locking engagement with the casing, is turned horizontally 180°, and thereafter repositioned on the casing in locked engagement therewith. In this form, a runner is preferably centrally located on the underside of the pitching rubber, with a plunger-receiving recess being formed at each end of the runner. Side runners are mounted on the interior of each abbreviated side wall. The casing is formed in the top wall thereof with a preferably centered guide way which corresponds in shape and location to the center runner on the rubber, and guide ways are formed in the upper side wall portions of the casing. A single plunger is employed, and means are provided for deactivating or rendering inoperative one of the locking recesses in the central runner on the underside of the rubber. The pitching rubber can then be inserted initially in much the same manner as the L-shaped pitching rubber, and when removed and rotated 180°, the deactivating means can be moved from its original recess to the recess at the opposite end of the center runner for rendering the recess so plugged inoperative when the pitching rubber is repositioned on the casing. Since, as above noted, the wearing and actual breaking away of the front top edge of the rubber is a major factor in requiring replacement of the pitching rubber, the provision of a second, similar surface doubles the life of the pitching rubber.

The casing for both home plate and the pitching rubber is preferably formed of a hard and durable plastic material adaptable to forming operations. Each casing is closed and hollow, with the possible exception of an opening provided in the top, side or end wall of the casing through which ballast material can be poured into the casing for enhancing and stabilizing the embedment of the casing. Such ballest may comprise concrete, wet sand, combinations of these materials, or other suitable materials appropriate for that purpose.

Both the pitching rubber and home plate are preferably constructed of a rubber composition currently in use, although other suitable compositions could alternatively be employed. Such material must have sufficient integrity to permit the runners to be rigidly secured by suitable fastening means such as screws or the like.

These and other objects of the invention will be apparent as the following description proceeds and particular reference to the application drawing.

BRIEF DESCRIPTION OF THE APPLICATION DRAWINGS

DETAILED DESCRIPTION OF THE PREFERRED EMBODIMENTS

Referring initially to the pitching rubber assembly illustrated in FIGS. 1–5, the assembly is generally indicated at 10 and comprises the pitching rubber 12 and a supporting casing 14. The assembly is shown in its operative position in FIGS. 1, 4 and 5, wherein the pitching rubber is releasably locked to the casing.

Figure 2:
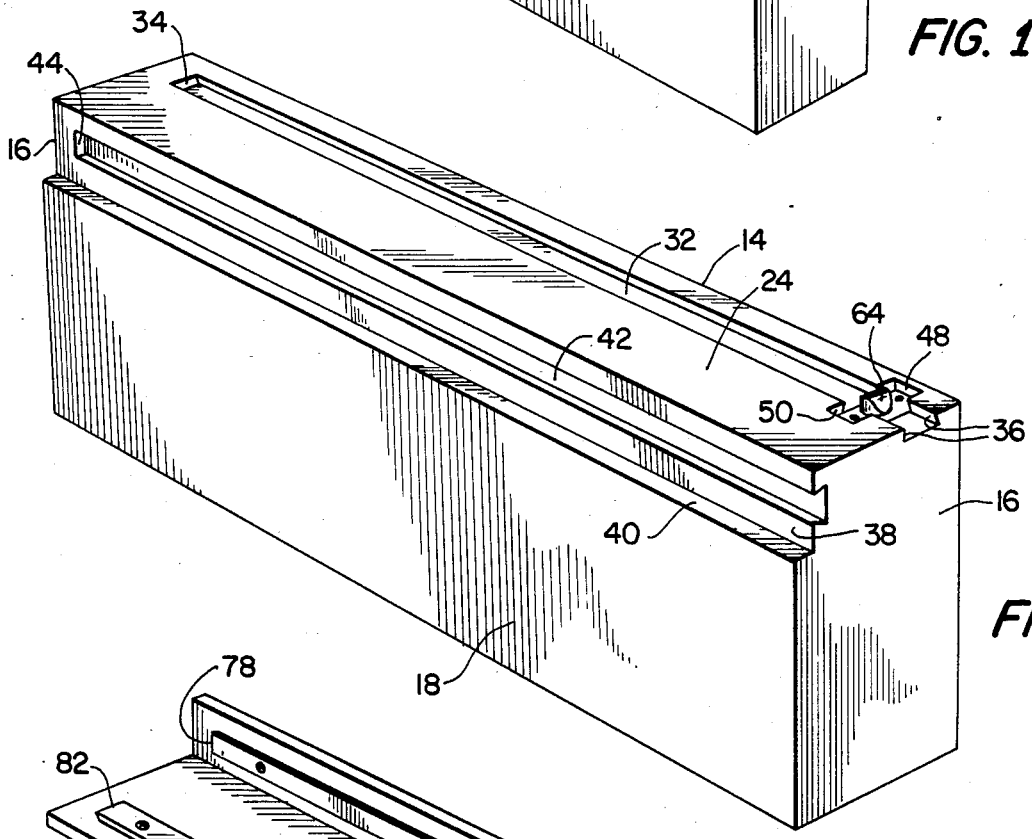
FIG. 2 is a front perspective view of the casing of the pitching rubber assembly.
Figure 4:
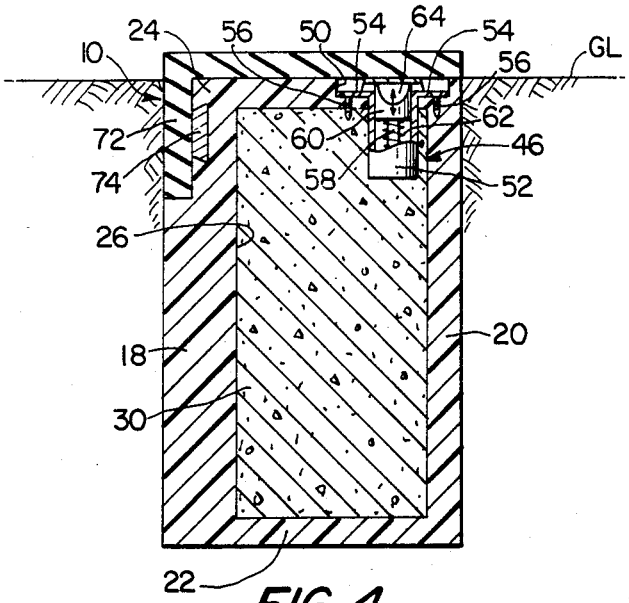
FIG. 4 is a vertical cross sectional view taken on line 4—4 of FIG. 1.
Figure 5:
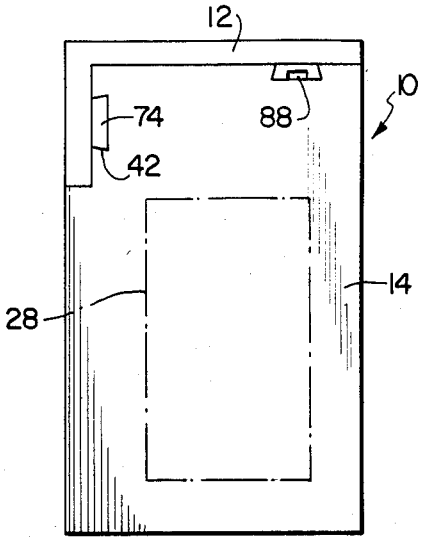
FIG. 5 is an end view of the assembly of FIG. 1, illustrating in dashed lines an opening through which ballast material can be admitted to the casing.

The construction of the casing is shown most clearly in FIGS. 2 and 4. The casing includes end walls commonly designated at 16, front wall 18, rear wall 20, bottom wall 22, and top wall 24. The walls define a hollow interior chamber 26, and the casing is entirely closed except for an opening 28 which can be formed in the top, side or end walls for purposes of introducing ballast or stabilizing material to the casing either before or after embedment. An opening 28 is shown diagrammatically in dashed lines in FIG. 5 for such purpose, although it will be understood that the opening can be formed at any desired position in the top, side or end wall, and can be of appropriate size. If desired, the opening can be plugged after the ballast has been introduced into the chamber. The ballast may partially or entirely fill the chamber 26, and may comprise concrete, wet sand, combinations of these materials, or any other desired materials which perform the desired stabilizing function and which per se form no part of the present invention. In FIG. 4, concrete 30 is illustrated which fills the chamber 26.

The casing 14 can be formed of wood, metal, plastic, or other suitable material, with a hard plastic being preferred due to its rigid characteristics and its ability to be inexpensively molded.

The top wall 24 of the casing is formed with a guide way 32 which extends substantially the length of the casing, terminating in an end portion 34 which serves as a stop to accurately position the pitching rubber in place as will be hereinafter described. The guide way 32 is generally dove-shaped, that is, is formed with side walls 36 which diverge downwardly and outwardly so as to prevent the upward withdrawal of the pitching rubber when the same has been assembled on the casing.

The side wall 18 of the casing is recessed near the top thereof to form an upper side wall portion 38, with a shoulder 40 being formed at the interface of the main wall 18 and the recessed wall 38. A second guide way 42 is formed in the recessed wall 38 and is of similar configuration to the guide wall 32 previously described. The guide way 42 terminates at its forward end at 44 which similarly serves as a stopping surface or shoulder to accurately position the pitching rubber on the casing.

A lock generally indicated at 46 is mounted in the guide way 32, with lateral cut out portions 48 and 50 being formed in the top wall 24 to accommodate the mounting of the lock. The lock per se forms no part of the present invention and in the form shown comprises a generally tubular housing 52 provided with outwardly extending flanges commonly indicated at 54 at the top thereof. The flanges 54 are apertured to receive fastening screws 56 or the like for mounting the housing in the guide way. Mounted within the housing 52 is a rod 58, the upper end of which carries a plunger 60, with the rod and plunger being biased upwardly by spring 62. The plunger has a cam surface 64 which can be engaged by a suitable tool for depressing the plunger thereby permitting the pitching rubber to be removed from the casing.

Figure 1:
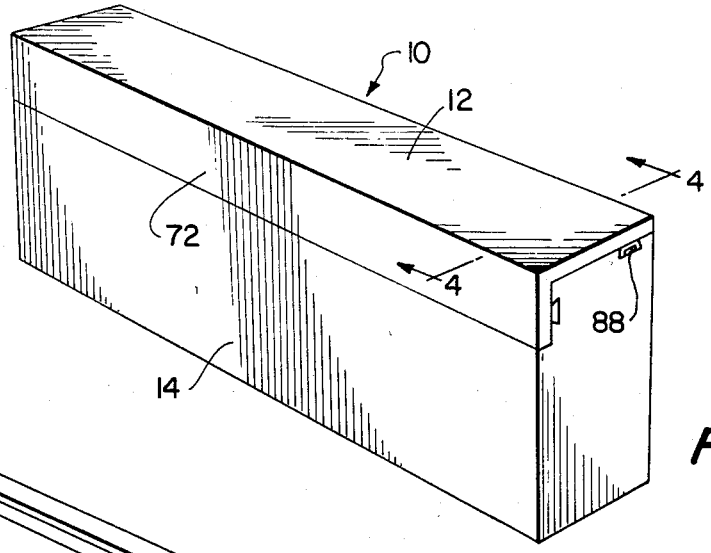
FIG. 1 is a front perspective view of the pitching rubber assembly constructed in accordance with the present invention, with the pitching rubber being shown mounted in place on the supporting casing.
Figure 3:
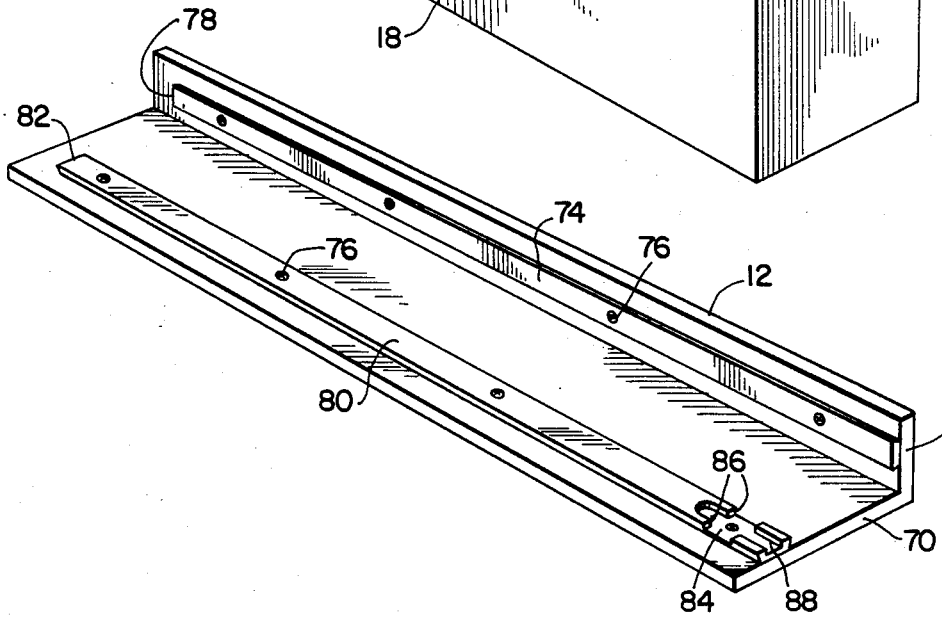
FIG. 3 is a front perspective view of the underside of the pitching rubber.

The pitching rubber 12 can best be seen from the front perspective view of FIG. 3 showing the underside of the rubber. The rubber 12 is generally L-shaped, comprising a relatively longer leg 70 which constitutes the top of the rubber, and a relatively shorter leg 72 which extends downwardly at the front of the rubber, as can be seen in FIG. 1. As above noted, pitching rubbers presently commercially available are in the form of flat slabs, and the provision of a front surface, in the form of the leg 72, enhances the effectiveness of the pitcher by providing a relatively hard yet resilient surface against which the shoe or spikes of the pitcher can engage. Since the pitcher "kicks off" from the leg positioned on the rubber during the pitching motion, the presence of the front pitching rubber surface 72 provides a more secure and effective surface.

Mounted on the inside of the leg 72 of the pitching rubber is a runner 74 which can be secured to the rubber by any suitable means, for example, fasteners 76 in the form shown. The runner 74 is similar in cross sectional shape to the guide way 42 whereby sliding engagement of the runner in the guide way provides an arrangement which permits longitudinal sliding movement of the rubber but prevents vertical movement of the rubber once the same is in proper position on the casing. The runner 74 is of substantially the same length as the guide way 42, terminating in a front wall surface 78 adapted to engage the wall 44 which defines the end of the guide way 42.

A similar runner 80 is secured to the main body 70 of the pitching rubber, by fasteners 76 or the like. The location and spacing of the runners 74 and 80 correspond to the location and spacing of the guide ways 32 and 42, respectively. The runner 80 likewise terminates at its forward end in a front wall surface 82 which engages the wall 34 which defines the end of the glide way 32.

The opposite end of the runner 80 is formed with a recess 84 which extends throughout the transverse dimension of the runner. The forward end of the recess is defined by stop shoulders commonly designated at 86 the spacing between which is less than the width of the plunger 64 whereby during positioning of the pitching rubber on the casing, the plunger is biased upwardly, with the front surface thereof engaging the stop shoulders 86. The front to rear dimension of the recess 84 is sufficient to accommodate the dimension of the plunger when in a locked position in the recess.

Immediately to the front of the recess 84, or to the right as shown in FIG. 3, a longitudinal key slot 88 is formed which permits access by a suitable tool to the plunger for depressing the same to permit withdrawal of the rubber from the casing for replacement purposes.

The installation of the pitching rubber assembly is as follows. The hollow casing is partially or completely filled with the desired ballast material, for example, prior to embedding the casing in the ground as shown in FIG. 4. The ballast material can be added subsequent to the embedment of the casing, but in such event, the access opening for the ballast material must be formed in the top wall 24 of the casing. During embedment of the casing, the exact location is determined, and once embedded, the casing remains in place, with the top of the casing being essentially at ground level GL, FIG. 4.

The pitching rubber is then inverted from its FIG. 3 form and the runners 74 and 80 aligned with the guide ways 42 and 32, respectively. The pitching rubber is then longitudinally slid forward, or to the left as shown in FIG. 2, with the front wall 82 of the runner 80 forcing down the cam surface of the plunger so as to depress the same against the bias of spring 62 to a position wherein the top of the plunger is essentially coplanar with the bottom of the guide way 32. Continued sliding movement of the pitching rubber results in the front walls 78 and 82 of the runners engaging the walls 44 and 34 at the ends of the guide ways, at which position the plunger 64 is aligned with the recess 84. The spring 62 then biases the plunger upwardly into contact with the bottom of the recess, with the essentially flat front face of the plunger engaging the stop shoulders 86 to lock and thus prevent backward sliding movement of the pitching rubber.

When in use, the pitching rubber, which can be formed of suitable rubber composition currently in use, or other suitable material, becomes worn due to spike marks, and in many instances the front edge of the rubber is actually broken away. When it is desired to replace the pitching rubber, which at the major league level can be as frequently as every five to fifteen games, a suitable tool, such as a small screw driver, is inserted into the key slot 88 so as to engage the cam surface of the plunger and depress the same. When the plunger is depressed so as to be essentially coplanar with the bottom of the guide way 32, the pitching rubber can be withdrawn from the casing and replaced. The removal of a worn pitching rubber and replacement by a new pitching rubber can be accomplished in a matter of seconds, and since the casing 14, during installation and embedment, is precisely aligned, the replacement of the pitching rubber requires no further alignment with either home plate or the bases.

The runners 74 and 80 can be formed of any suitable material, for example, metal, wood or hard plastic. If desired, the runners can be molded into the rubber during the molding of the rubber itself, with the recess 84 and key slot 88 being formed during molding or during subsequent forming operations.

The construction and function of the home plate assembly, generally indicated at 100 in FIGS. 6–10, is similar in many respects to the construction and function of the pitching rubber assembly illustrated in FIGS. 1–5. The assembly 100 includes a casing 102 and a home plate 104 of the required configuration. The casing 102 includes a rear wall 106, side walls 108 and 110, top wall 112, a pair of angular front walls 114 and 116, and a bottom wall 118. The casing is entirely closed and hollow, except for an opening 119 which can be formed in one of the walls thereof for introducing ballast material, with such opening being shown in dashed lines at 118 in FIG. 10. The opening 119 can be shaped and located as desired, and can even comprise an opening in the top wall 112 in the event it is desired to add weight or ballast material to the casing when it has been embedded. Any such opening can be plugged if desired.

The top wall 112 of the casing 102 is formed with a plurality of longitudinally extending guide ways, there being three such guide ways shown in the drawing figures and indicated at 120, 122, and 124. The guide ways are similarly dove-shaped, with the center guide way 122 terminating at a front wall 126 which provides a locating stop for home plate when the same is releasably locked on the casing. The means for locking home plate on the casing can be and preferably is as previously described and illustrated in FIG. 4, and the same reference numerals have accordingly been applied to FIG. 7 and primarily FIG. 9.

The casing 102 can be formed of wood, metal, plastic, or other suitable material, although hard plastic is preferred for the reasons previously noted concerning the casing 14. Likewise, home plate 104 can be formed of rubber composition of the type currently in use, or other similar substances having the necessary characteristics of resiliency yet sufficient rigidity.

Figure 8:
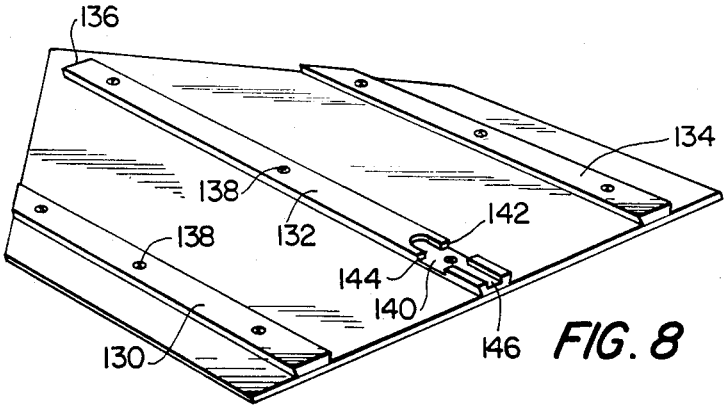
FIG. 8 is a front perspective view of the underside of the home plate construction.
Figure 9:
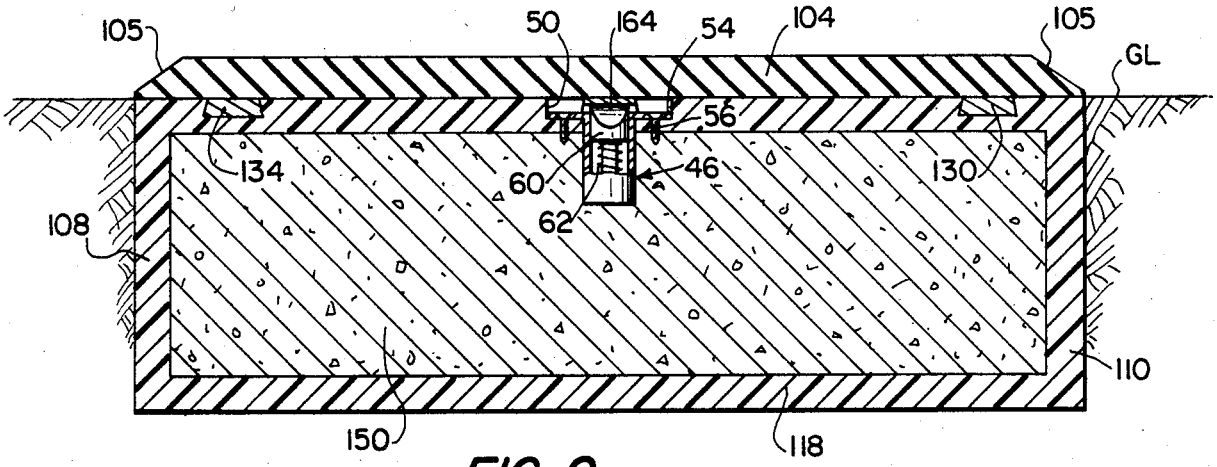
FIG. 9 is a vertical sectional view taken on line 9—9 of FIG. 6, and showing the home plate construction embedded in operative position.
Figure 10:
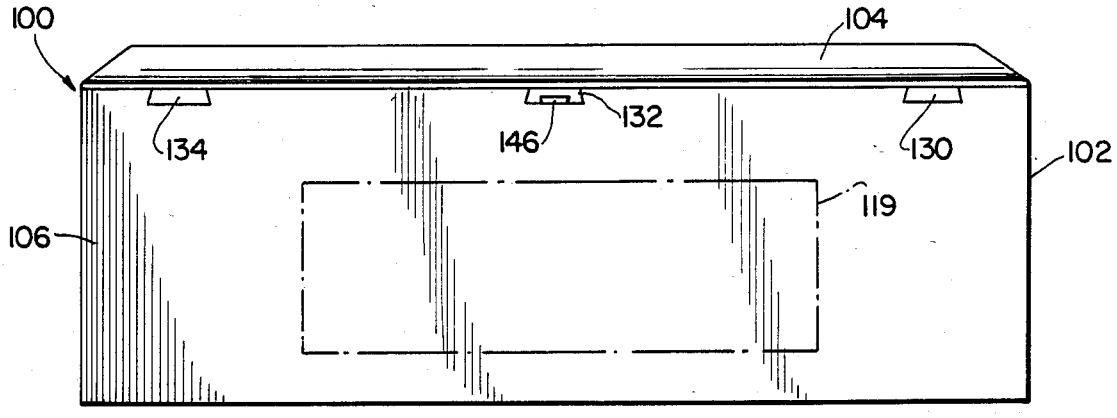
FIG. 10 is an end elevational view of the home plate assembly, with an opening being shown in dashed lines in the end wall for adding ballast to the hollow casing.

Referring to FIG. 8, runners 130, 132 and 134 are formed on the underside of home plate, with the runners 130 and 134 terminating at the juncture of the runners with the front walls 114 and 116 of the casing, and the center runner 132 terminating short of the front wall, as shown at 134. The runners can be formed of metal, wood, plastic, or other suitable materials, and in the form shown are secured to home plate by fastening members commonly indicated at 138. Similar to the runners 74 and 80, the runners 130, 132 and 134 are shaped complimentary to the grooves 120–124 so as to be received therein during the mounting of the plate on the casing.

The center runner 132 is formed with an opening or recess 140 similar in shape and function to the recess 84 illustrated in FIG. 3. Stop shoulders 142 and 144 partially define the forward end of the recess 140, with the spacing between the shoulders being less than the width of the plunger 64, as above described. A longitudinally formed key slot is formed at the extreme forward end of the runner 132, communicating with the recess 140 and also with the front surface of the runner and the plate. The key slot is sufficiently large in vertical dimension to permit a suitable tool, such as a small screw driver, to be inserted into the slot for engagement with and depression of the plunger of the lock assembly, as previously explained.

In the installation and use of the home plate assembly 100, the casing 102 is embedded in accurately aligned position, with the top wall 112 of the casing being substantially at ground level GL. Fill or ballast material can be introduced into the hollow casing through a suitable opening, diagrammatically shown at 119, before the casing is embedded, or through an opening formed in the top wall 112 in the event the ballast is added subsequent to embedment. In either event, the opening can be plugged following partial or complete filling of the hollow casing. The fill material can comprise wet sand, concrete, dirt, or other suitable and relatively heavy material, with concrete 150 being shown in FIG. 9 completely filling the interior of the casing.

Figure 7:
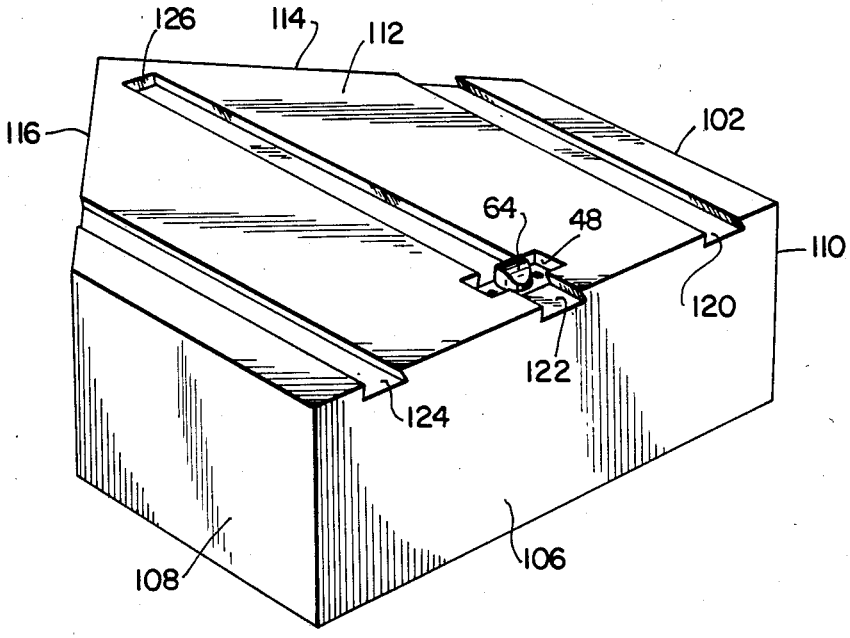
FIG. 7 is a front perspective view of the casing of the home plate assembly of FIG. 6.

After the casing is in place, home plate 104, which can be formed with chamfered edges 105 in the usual manner, is mounted on and locked to the casing by aligning the leading edges of the runners 130–134, shown left-most in FIG. 8, with the front end, shown right-most in FIG. 7, of the guide ways 120–124. Following such alignment, the plate is moved to the left as shown in FIG. 7, with the front wall 136 of the center runner 132 engaging the cam surface of the plunger 60 and camming the same downwardly against the bias of the spring 62 to a position in which the top of the plunger is coplanar with the bottom of the guide way. The center runner 132, and consequently the side runners, 130 and 134, can then be moved to a locked position on the casing, at which the front wall 136 of the runner 132 engages the end 126 of the guide way 122, and the front, flat surface of the plunger engages the stop shoulders 142 and 144. In such position, the plate is precisely aligned over the casing so that no further alignment and measurement of home plate relative to the bases and the pitching rubber is required. Unless and until the plunger 60 is depressed, the plate is locked in its assembled position.

Figure 6:
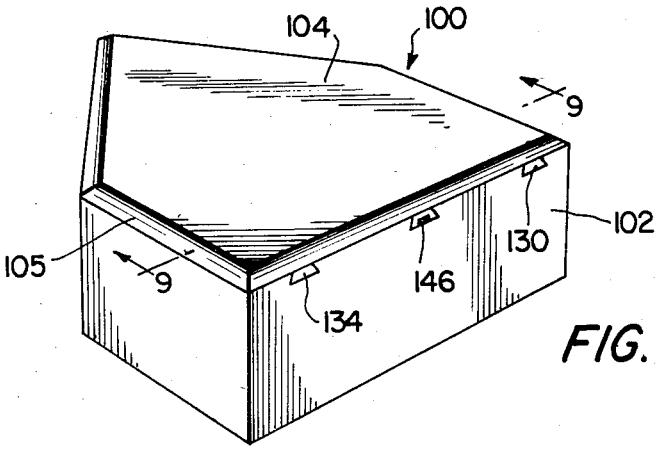
FIG. 6 is a front perspective view of the home plate assembly constructed in accordance with the present invention, with the home plate being shown in an assembled position.

When it is desired to remove and replace the plate due to its worn condition, which similarly occurs approximately every five to fifteen games at the major league level, a suitable tool is inserted in the key slot 146 for depressing the plunger 60, after which the plate can be slid from operative engagement with the casing, in a direction to the right as shown in the assembled position of the plate in FIG. 6. A worn plate can thus be very quickly and easily removed from the casing and a new plate inserted and locked in engagement with the casing and precisely aligned therewith.

Figure 11:
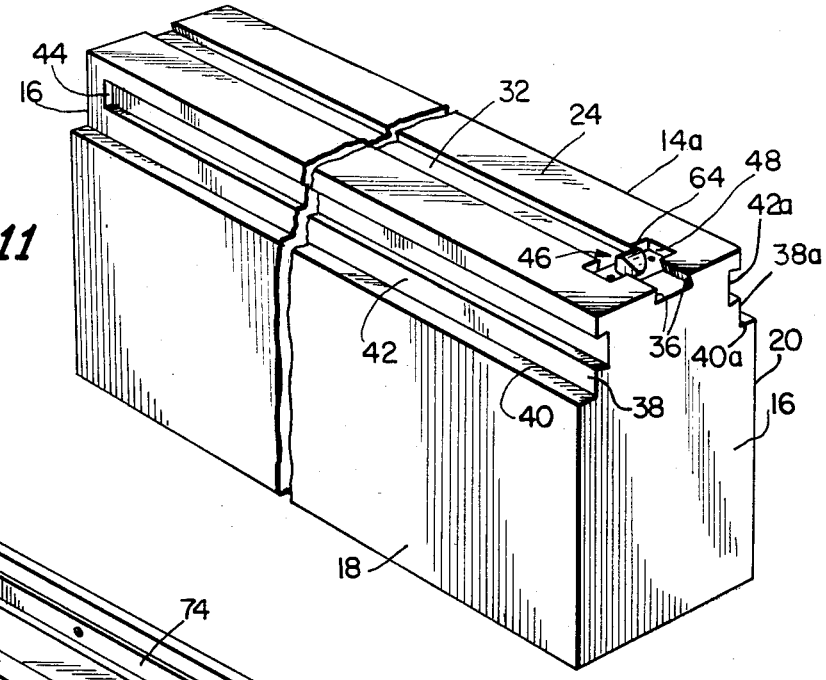
FIG. 11 is a front perspective view, partially fragmented, showing an alternative form of casing construction in which guide ways are formed near the top of each side wall of the casing, and a generally centrally located guide way is formed in the top wall of the casing.
Figure 12:
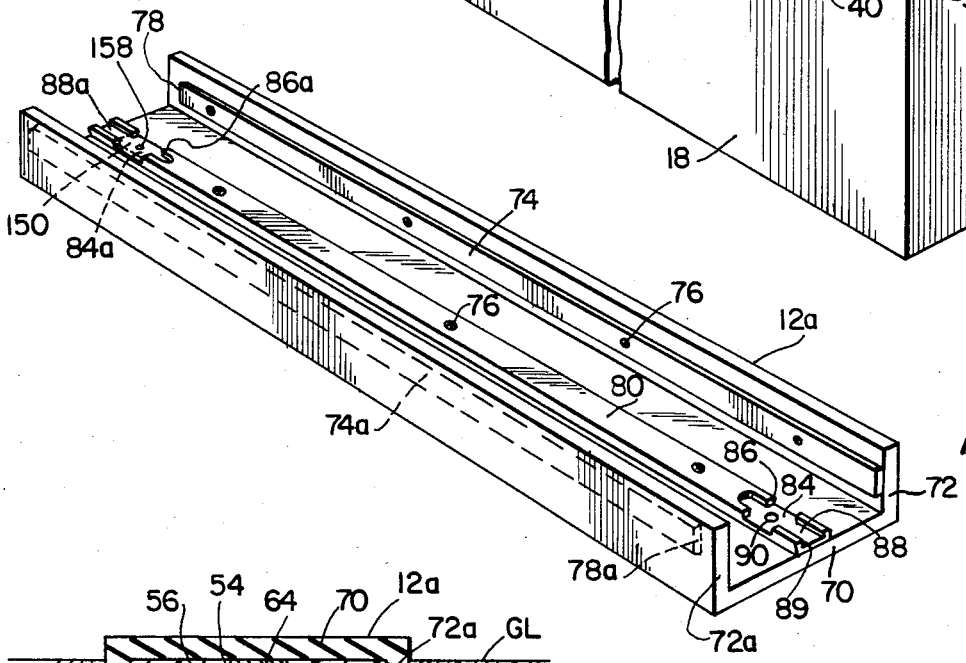
FIG. 12 is a front perspective view similar to FIG. 3, showing the underside of the pitching rubber adapted to be mounted on the modified casing shown in FIG. 11.
Figure 13:
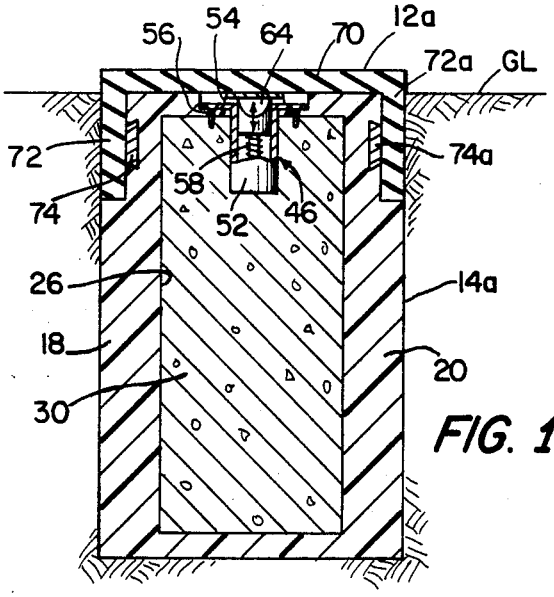
FIG. 13 is a vertical cross sectional view similar to FIG. 4, but showing the modified embodiments of casing and pitching rubber illustrated in FIGS. 11 and 12.

There is illustrated in FIGS. 11–13 an alternative form of the invention which is specifically designed to permit reversal of the pitching rubber to provide a fresh front rubber surface and edge, thereby prolonging the life of the pitching rubber. Since many features of the FIGS. 11–13 form are similar to the features illustrated in FIGS. 2–4, the same reference numerals, where applicable, have been applied, and where structure has been duplicated to accomplish the intended purposes, the reference numeral suffix "a" has been employed.

The casing 14*a* illustrated in perspective, broken view in FIG. 11, is comparable in all respects to the casing 14 shown in FIG. 2, with the following exceptions. The upper side wall portion 38*a* of the wall 20, which appears at the back in FIG. 11, is similarly recessed and formed with an opposed guide way 42*a* which is vertically aligned with the guide way 42 formed in the side wall 18. The guide way 42*a* extends throughout the length of the pitching rubber. Secondly, the guide way 32 formed in the top wall 24 is preferably centralized in a transverse direction, and the guide way is open at both ends to accommodate reversal of the rubber. As can be seen in FIG. 13, the side wall 20 is increased in thickness relative to the side wall 20 of the FIG. 3 form, to permit the recessing of the side wall at 38*a* near the top thereof, and the formation of the guide way 42*a* in such recessed portion. Only a single lock 46 is utilized, the construction and function of which is as previously described.

Referring to FIG. 12, which shows the underside of the modified pitching rubber, the rubber is comparable to the pitching rubber shown in FIG. 3, with the following exceptions. The pitching rubber is of shallow, relatively U-shape in cross section, with a second leg 72*a* thus being provided. A rail 74*a* is mounted on the inner surface of the leg 72*a*, with the runner terminating at its front end, shown at the right in FIG. 12, at 78*a*, spaced from the end of the wall 72. The opposite end of the rail 74*a* extends to the end of the pitching rubber. Thus, the end surfaces 78 and 78*a* form stops or shoulder surfaces which engage the forward end 44 of guide way 42, regardless of the orientation of the pitching rubber when it is positioned in locking engagement on the casing.

A further distinction is the transverse centering of the runner 80 on the leg 70 of the pitching rubber, with the position of the runner corresponding to the generally central location of the guide way 32 formed in the casing 14*a*. In order to accommodate the end for end transposition of the pitching rubber, a recess 84*a* is formed at the opposite end of the runner 80, with a longitudinal key slot 88*a* similarly being provided as previously illustrated and described. Also, the key slots 88 and 88*a* are dove-tailed as shown at 89 to receive a deactivating insert and the runner in the area of tne recess 84 is formed with a threaded opening or threaded sleeve 90 to temporarily secure the insert in place, as will be hereinafter described.

The pitching rubber 12*a* is mounted on the casing 14*a* in essentially the same manner as previously described. However, in view of the presence of both recesses 84 and 84*a*, provision must be made for deactivating the leading recess as the pitching rubber is slid longitudinally on the casing, with the term "leading" meaning the recess first passing over the plunger. If no deactivation is made, the plunger would be biased upwardly into engagement with the leading recess thereby preventing continued sliding movement of the pitching rubber to its operative, locked position. Although a deactivating tool such as a screw driver or the like could be employed to depress the plunger, the cantilevered position of the pitching rubber relative to the casing makes the manipulation of a deactivating tool relatively difficult.

Figure 14:
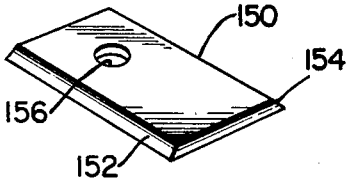
FIG. 14 is a perspective view showing one means for deactivating the non-used plunger recess formed in the center runner on the underside of the pitching rubber of the FIG. 12 embodiment.

Rendering the leading recess 84 or 84*a* deactivated or inoperative can be accomplished by providing an insert 150, shown in perspective and greatly enlarged in FIG. 14. The insert is of a width and height to be easily and quickly inserted through the key slot 88 or 88*a*, and is of a length that it engages the stop shoulders 86 or 86*a* when fully inserted. In the form shown, the plug or insert 150 is formed with dove-shaped side walls 152 and 154 which engage the dove-shaped key slot opening for preventing vertical movement of the insert relative to the runner. The side walls of the key slot 88 and insert 150 could be formed straight and the insert tightly frictionally retained in the key slot.

The insert 150 is formed with a preferably countersunk opening 156 which can be aligned with the threaded opening or sleeve 90 formed in the runner when the insert is positioned, with a screw 158 (shown at the left in FIG. 12) extending into the opening or sleeve to temporarily retain the insert in place.

The insert can be made of any suitable material, for example, wood or metal, and shaped as illustrated or described. A slightly oversized plastic plug could also be employed which can be pressed into the key slot and be frictionally retained by the walls thereof. Regardless of the materials used and the method of mounting the insert, the same must extend over the recess 84 or 84*a* as described.

In using the embodiment shown in FIGS. 11–13, the insert 150 is positioned and secured by screw 158 so as to cover either the recess 84 or 84*a*. The pitching rubber is then inverted from its FIG. 12 form, and the rails 74, 74*a* and 80 aligned with the guide ways 42, 42*a* and 32, respectively. Assuming that the insert covers the recess 84*a*, as shown in dashed lines in FIG. 12, that end of the pitching rubber when inverted would be so aligned, and the pitching rubber slid longitudinally over the casing. Since the insert is of the thickness substantially the same as the thickness of the runner 80, the plunger 60 is depressed by the leading end of the runner, and remains depressed due to the insert. When the pitching rubber reaches its aligned position on the casing, wherein the ends 78 or 78*a* engage the forward end 44 of the guide way 42, the plunger head 64 is biased upwardly into the open recess, in this case recess 84 as shown in FIG. 12, thereby locking the pitching rubber in place. Once the insert is in place, the installation of the pitching rubber is thus identical with the installation previously described. The plunger 60 and the engagement of the end 78 or 78*a* of the runners with surface 44 prevent longitudinal movement of the pitching rubber in either direction until the plunger is depressed.

As described, the front edge of the rubber becomes defaced and broken off during use, with the edge in the installation as described comprising the edge defined by the walls 70 and 72. By contrast, the top edge of the rubber defined by walls 70 and 72*a* remains relatively intact due to the normal use of the rubber by the pitcher. When the pitching rubber edge being used becomes sufficiently defaced or worn away due to use, a suitable tool can be inserted through the key slot 88, and the plunger 64 depressed to permit withdrawal of the pitching rubber from the casing. The presence of the insert 150 in the opposite recess permits complete withdrawal of the pitching rubber without the plunger being biased upwardly into engagement with the opposite recess.

When the pitching rubber has been removed, the insert 150 is removed and secured in the opposite recess, in this instance recess 84, and the pitching rubber rotated horizontally end for end so that the end of the pitching rubber having the recess 84 becomes the leading edge. Since recess 84 is rendered inoperative by the insert 150, the pitching rubber when so rotated end to end can be quickly and easily longitudinally mounted on the casing, with the plunger 64 engaging the now open recess 84*a* when the pitching rubber has reached its precisely aligned position. Such aligned position is maintained due to the engagement of the runner end 78*a* with the forward end 44 of the guide way 42, in which position the plunger is exactly aligned with the stop shoulders 86. In this manner, a pitching rubber is provided which effectively doubles its useful life.

It will be noted that the insert 150 not only deactivates the plunger, but visibly fills the key slot, whereby the person changing the pitching rubber can insert the tool only through the open center key slot for gaining access to the plunger for depressing the same.

The runners 74 and 74*a* could terminate at each end so as to provide stop surfaces at each side of the rubber. In such event, the initial alignment of the pitching rubber on the casing would only be through the center runner. The arrangement illustrated and described, in which only a single stop surface 78 or 78*a* is provided, has proved satisfactory, and serves to facilitate the initial alignment and sliding action.

It will thus be seen that the present invention is a considerable improvement over current home plate and pitching rubber constructions and securing methods. In both the home plate and pitching rubber assemblies, the casing can be precisely aligned and embedded with ballast material in the proper material in the proper location. Once embedded, the casing in each instance remains in place. Home plate and the pitching rubber can be quickly and easily mounted and locked to the casing, again in precise alignment with the associated casing so as to avoid the further need for measurement. When worn, home plate and the pitching rubber can be quickly and easily replaced. The pitching rubber in the FIGS. 11–13 invention form affords the further advantage of being formed with reversible downwardly extending wall portions which in effect doubles the useful life of the rubber. Although preferred materials have in certain instances been indicated above, no invention resides in the particular material used for either the casings, home plate, pitching rubber or runners, and any suitable material can be used for these components, consistent with cost and wearing ability.

I claim:

1. A pitching rubber assembly comprising;

(a) a casing adapted to be partially embedded in a pitching mound and being substantially flat with the ground at the upper end thereof;

(b) a pitching rubber adapted to be positioned at the top of said casing;

(c) guide means provided respectively on said casing and pitching rubber for cooperable engagement for precisely positioning said pitching rubber on said casing in a desired position, said guide means comprising guide ways formed in spaced relation in said casing, and runners on the interior surface of said pitching rubber, said runners being spaced commensurate with the spacing of said guide ways, whereby said pitching rubber, through alignment of said runners with said guide ways, is longitudinally slidable relative to said casing so as to position said pitching rubber in the desired position; and (d) means for removably locking said pitching rubber on said casing, comprising a lock assembly mounted in one of said guide ways in said casing, said lock assembly including a resiliently biased plunger extending upwardly into said guide way, and a plunger-receiving recess formed in one of said runners provided on said pitching rubber, the position of said recess relative to said plunger being such that when said pitching rubber is longitudinally slidably moved along said casing to the desired position, said plunger is biased upwardly into said recess thereby locking said pitching rubber in place.

2. The pitching rubber assembly of claim 1 wherein said guide ways are dove-shaped in cross section and extend substantially the length of said casing, and said runners are of similar cross section to snugly fit in said guide ways, such arrangement permitting said longitudinal sliding movement and preventing upward withdrawal of said pitching rubber from said casing.

3. The pitching rubber assembly of claim 1 wherein said runner formed with said recess is further formed with a key slot in the end thereof adjacent said recess, whereby a tool can be inserted in said key slot and said plunger depressed for permitting slidable retraction of said pitching rubber from said casing.

4. The pitching rubber assembly of claim 3 wherein said casing is closed at the exterior thereof and hollow in the interior thereof except for an opening formed in a wall thereof, said opening permitting filling material to be inserted into said casing for increasing the weight and thus the stability of said casing.

5. The pitching rubber assembly of claim 1 wherein said casing is formed of molded plastic material, and said pitching rubber is formed of composition rubber.

6. The pitching rubber assembly of claim 1 wherein said pitching rubber is generally L-shaped, and wherein said guide ways are formed in the top wall and the upper region of the side wall of said casing, said guide ways and said runners being shaped in cross section so as to permit longitudinal sliding of said runners in said guide ways but prevent upward movement of said pitching rubber away from said casing.

7. The pitching rubber assembly of claim 1 wherein said pitching rubber is of generally inverted U-shape, to provide opposed pitching edges, and wherein said guide ways are formed in the top wall and the upper regions of the side walls of said casing, and said runners are formed on the respective legs of said pitching rubber, said guide ways and said runners being shaped in cross section so as to permit longitudinal sliding of said runners in said guide ways but prevent upward movement of said pitching rubber away from said casing.

8. The pitching rubber assembly of claim 7 wherein said runner associated with said guide way formed in the top wall of said casing is formed with a plunger-receiving recess relatively adjacent each end thereof, whereby said pitching can be rotated horizontally 180° and repositioned on said casing, and means for deactivating one of said two plunger-receiving recesses while the other of said recesses is exposed so as to lock said pitching rubber in place.

9. The pitching rubber assembly of claim 8 wherein said deactivating means comprises means releasably positioned in said recess to be deactivated, said deactivating means being essentially the same height as the height of said runner so as to present a coplanar surface therewith when mounted, whereby said plunger rides over said deactivating means during positioning of said rubber in the reversed position thereof, with said plunger extending into the other of said recesses when said positioning rubber is moved to its locking position.

10. The pitching rubber assembly of claim 9 wherein said runner formed with said recesses is further formed with a key slot in the outer end thereof adjacent each of said recesses, whereby a tool can be inserted in the key slot adjacent the locking plunger and depressed for permitting slidable retraction of said pitching rubber from said casing.

11. The pitching rubber assembly of claim 9 wherein said deactivating means comprises insert means positioned in the deactivted recess and extending longitudinally of said key slot adjacent said deactivated recess, whereby only that key slot adjacent the locked plunger is accessible by said tool for permitting slidable retraction of the pitching rubber from the casing.

12. A home plate assembly comprising:

(a) a casing adapted to be partially embedded in the ground and being substantially flat with the ground at the upper end thereof;

(b) a plate adapted to be positioned at the top of said casing;

(c) guide means provided respectively on said casing and said plate for cooperable sliding engagement for precisely positioning said plate on said casing in a desired position, said guide means comprising guide ways formed in spaced relation in said casing, and runners on the interior surface of said home plate, said runners being spaced commensurate with the spacing of said guide ways, whereby said home plate, through alignment of said runners with said guide ways, is longitudinally slidable relative to said casing so as to position and lock said plate in the desired position; and (d) means for removably locking said plate on said casing, comprising a lock assembly mounted in one of said guide ways in said casing, said lock assembly including a resiliently biased plunger extending upwardly into said guide way, and a plunger-receiving recess formed in one of said runners provided on said plate, the position of said recess relative to said plunger being such that when said plate is longitudinally slidably moved along said casing to the desired position, said plunger is biased upwardly into said recess thereby locking said plate in place.

13. The home plate assembly of claim 12 wherein said guide ways are dove-shaped in cross section and extend substantially the length of said casing, and said runners are of similar cross section to snugly fit in said guide ways, such arrangement permitting said longitudinal sliding movement and preventing upward withdrawal of said plate from said casing.

14. The home plate assembly of claim 12 wherein said runner formed with said recess is further formed with a key slot in the end thereof adjacent said recess, whereby a tool can be inserted in said key slot and said plunger depressed for permitting slidable retraction of said plate from said casing.

15. The home plate assembly of claim 12 wherein said casing is closed at the exterior thereof and hollow in the interior thereof except for an opeing formed in a wall thereof, said opening permitting filling material to be inserted into said casing for increasing the weight and thus the stability of said casing.

* * * * *